US009133843B2

(12) United States Patent
Tsuka et al.

(10) Patent No.: US 9,133,843 B2
(45) Date of Patent: Sep. 15, 2015

(54) SCROLL COMPRESSOR HAVING FIRST AND SECOND OIL GROOVES FORMED IN FIXED AND ORBITING SCROLL THAT ARE COMMUNICABLE

(75) Inventors: Yoshitomo Tsuka, Osaka (JP); Youhei Nishide, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 100 days.

(21) Appl. No.: 14/005,689

(22) PCT Filed: Mar. 6, 2012

(86) PCT No.: PCT/JP2012/001513

§ 371 (c)(1),
(2), (4) Date: Sep. 17, 2013

(87) PCT Pub. No.: WO2012/127795

PCT Pub. Date: Sep. 27, 2012

(65) Prior Publication Data

US 2014/0010694 A1 Jan. 9, 2014

(30) Foreign Application Priority Data

Mar. 23, 2011 (JP) ..... 2011-064599

(51) Int. Cl.
*F03C 2/00* (2006.01)
*F04C 2/00* (2006.01)
(Continued)

(52) U.S. Cl.
CPC ..... *F04C 18/02* (2013.01); *F04C 15/0088* (2013.01); *F04C 18/0215* (2013.01);
(Continued)

(58) Field of Classification Search
CPC .. F04C 18/0253; F04C 18/2015; F04C 18/02; F04C 18/16; F04C 15/0088; F04C 23/008; F04C 27/02; F04C 29/02; F04C 29/023; F04C 29/028; F04C 29/026; F04C 29/0007; F01C 1/0215; F01C 1/0253; F01C 21/04
USPC ..... 418/55.1–55.6, 57, 84, 94, 97, 99–100
See application file for complete search history.

(56) References Cited

U.S. PATENT DOCUMENTS

| | | | | |
|---|---|---|---|---|
| 5,645,408 | A * | 7/1997 | Fujio et al. | 418/55.6 |
| 6,533,561 | B1 | 3/2003 | Furusho et al. | |
| 2006/0216182 | A1 * | 9/2006 | Kohsokabe et al. | 418/55.6 |

FOREIGN PATENT DOCUMENTS

| | | | |
|---|---|---|---|
| EP | 1 710 438 | A2 | 10/2006 |
| JP | 60-145483 | A | 7/1985 |

(Continued)

OTHER PUBLICATIONS

European Search Report of corresponding EP Application No. 12 76 0312.4 dated Jul. 14, 2014.
International Search Report of corresponding PCT Application No. PCT/JP2012/001513, dated Jun. 5, 2012.

(Continued)

*Primary Examiner* — Theresa Trieu
(74) *Attorney, Agent, or Firm* — Global IP Counselors

(57) ABSTRACT

A scroll compressor includes a compression mechanism having a fixed scroll and an orbiting scroll. The fixed scroll includes a first end plate, an outer peripheral wall extending from an edge of the first end plate, a first oil groove, and a first wrap inside of the outer peripheral wall. The orbiting scroll includes a second end plate in sliding contact with an end of the first wrap and an end of the outer peripheral wall, a second oil groove, and a second wrap. The first oil groove is disposed on a surface of the outer peripheral wall, extends along an inner periphery of the outer peripheral wall, and is configured to receive lubricating oil at a high pressure corresponding to a discharge pressure of the compression mechanism. The second oil groove is disposed on a surface of the second end plate, and is communicatable with the first oil groove.

1 Claim, 8 Drawing Sheets

(51) Int. Cl.

| | |
|---|---|
| ***F04C 18/00*** | (2006.01) |
| ***F04C 18/02*** | (2006.01) |
| ***F04C 29/02*** | (2006.01) |
| ***F04C 18/16*** | (2006.01) |
| ***F04C 15/00*** | (2006.01) |
| *F04C 23/00* | (2006.01) |

(52) U.S. Cl.

CPC ..... *F04C18/0253* (2013.01); *F04C 18/16* (2013.01); *F04C 29/02* (2013.01); *F04C 29/023* (2013.01); *F04C 29/028* (2013.01); *F04C 23/008* (2013.01)

(56) References Cited

FOREIGN PATENT DOCUMENTS

| | | | |
|---|---|---|---|
| JP | 2005-48666 | A | 2/2005 |
| JP | 3731433 | B2 | 10/2005 |
| JP | 2009-174500 | A | 8/2009 |
| JP | 2012-77616 | A | 4/2012 |

OTHER PUBLICATIONS

International Preliminary Report of corresponding PCT Application No. PCT/JP2012/001513, dated Jun. 5, 2012.

* cited by examiner

SCROLL COMPRESSOR HAVING FIRST AND SECOND OIL GROOVES FORMED IN FIXED AND ORBITING SCROLL THAT ARE COMMUNICABLE

CROSS-REFERENCE TO RELATED APPLICATIONS

This U.S. National stage application claims priority under 35 U.S.C. §119(a) to Japanese Patent Application No. 2011-064599, filed in Japan on Mar. 23, 2011, the entire contents of which are hereby incorporated herein by reference.

TECHNICAL FIELD

The present invention relates to scroll compressors, more particularly to a lubrication structure in a scroll compressor.

BACKGROUND ART

Conventionally, scroll compressors have been known which include a compression mechanism having a fixed scroll and an orbiting scroll.

Japanese Patent No. 3731433 discloses this type of scroll compressor, which includes a compression mechanism having a fixed scroll and an orbiting scroll. Specifically, the fixed scroll includes a disc-shaped end plate, a cylindrical outer peripheral wall standing on an edge of the end plate of the fixed scroll, and a scroll wrap standing inside the outer peripheral wall. The orbiting scroll includes an end plate that is in sliding contact with ends of the outer peripheral wall and the wrap of the fixed scroll. The orbiting scroll also includes a wrap standing on the end plate of the orbiting scroll. In the compression mechanism, the scrolls meshing with each other form compression pockets therebetween. The orbiting scroll eccentrically orbiting the fixed scroll gradually decreases the volume of the compression pockets, thereby compressing fluid in the compression pockets.

Such a scroll compressor disadvantageously increases sliding resistance on a contact surface between the fixed scroll and the orbiting scroll. To avoid this problem, the scroll compressor of U.S. Pat. No. 3,731,433 includes an oil groove on a surface, of the outer peripheral wall of the fixed scroll, on which the fixed scroll is in sliding contact with the orbiting scroll. High pressure lubricating oil on the oil groove decreases the sliding resistance on the sliding contact surface.

SUMMARY

Technical Problem

In the above-described configuration where the oil groove is disposed on the outer peripheral wall of the fixed scroll, the oil groove that is sealed inadequately causes leakage of lubricating oil to a space around the outer periphery of the orbiting scroll. Specifically, a relatively long oil groove disposed along an inner circumference of the outer peripheral wall of the fixed scroll makes relatively short a distance (a sealing length) from the oil groove on a certain portion of the outer peripheral wall to an end of an outer periphery of the end plate of the orbiting scroll. The high pressure lubricating oil leaks from the oil groove having the short sealing length to the outer periphery of the end plate through the end plate of the orbiting scroll. That is, the lubricating oil supplied to the oil groove is uselessly discharged to the outside of the orbiting scroll, and this results in poor lubrication on a sliding-contact surface (a so-called thrust surface) on the outer peripheral wall.

The orbiting scroll eccentrically orbits the fixed scroll. Thus, at a certain angle of orbital movement, the sealing length might be significantly short. That is, at this angle of orbital movement, the lubricating oil in the oil groove leaks significantly. This results in poor lubrication on the thrust surface of the outer peripheral wall, thereby reducing the reliability of the scroll compressor.

It is therefore an object of the present invention to provide a scroll compressor having an increased lubrication area on a thrust surface to reliably lubricate the sliding surface.

Solution to the Problem

A first aspect of the invention is directed to a scroll compressor including a compression mechanism (40). The compression mechanism (40) includes a fixed scroll (60) and an orbiting scroll (70). The fixed scroll (60) includes an end plate (61), an outer peripheral wall (63), and a wrap (62). The outer peripheral wall (63) stands on an edge of the end plate (61). The wrap (62) stands inside the outer peripheral wall (63). The orbiting scroll (70) includes an end plate (71) and a wrap (72). The end plate (71) is in sliding contact with an end of the wrap (62) of the fixed scroll (60) and an end of the outer peripheral wall (63). The wrap (72) stands on the end plate (71). The scroll compressor includes an oil groove (80) on the fixed scroll and an oil groove (83) on the orbiting scroll. The oil groove (80) on the fixed scroll is disposed on a surface, of the outer peripheral wall (63) of the fixed scroll (60), that is in sliding contact with the end plate (71) of the orbiting scroll (70). The oil groove (80) on the fixed scroll extends along an inner periphery of the outer peripheral wall (63). The oil groove (80) on the fixed scroll receives lubricating oil at a high pressure corresponding to a discharge pressure of the compression mechanism (40). The oil groove (83) on the orbiting scroll is disposed on a surface, of the end plate (71) of the orbiting scroll (70), that is in sliding contact with the outer peripheral wall (63) of the fixed scroll (60). The oil groove (83) on the orbiting scroll can communicate with the oil groove (80) on the fixed scroll.

In the first aspect of the invention, the oil groove (80) on the fixed scroll is disposed on the sliding-contact surface of the outer peripheral wall (63) of the fixed scroll (60). Lubricating oil at a high pressure corresponding to a discharge pressure of the compression mechanism (40) is supplied to the oil groove (80) on the fixed scroll. The lubricating oil is supplied to the sliding-contact surface between the outer peripheral wall (63) and the end plate (71) of the orbiting scroll (70) to lubricate this sliding-contact surface. The oil groove (80) on the fixed scroll is preferably long along the inner periphery of the outer peripheral wall (63) to increase the lubrication area between the outer peripheral wall (63) of the fixed scroll (60) and the end plate (71) of the orbiting scroll (70). However, such a long oil groove (80) on the fixed scroll, of which the sealing length of the oil groove (80) on the fixed scroll is short, might cause the lubricating oil in the oil groove (80) on the fixed scroll to continuously leak to the outside of the end plate (71) of the orbiting scroll (70).

To avoid this problem, in the present invention, the oil groove (83) on the orbiting scroll is disposed on the end plate (71) of the orbiting scroll (70). The oil groove (83) on the orbiting scroll can communicates with the oil groove (80) on the fixed scroll. The oil groove (83) on the orbiting scroll is disposed on the surface, of the end plate (71), that is in sliding contact with the outer peripheral wall (63) of the fixed scroll (60). Consequently, the introduction of the lubricating oil in the oil groove (80) on the fixed scroll to the oil groove (83) on the orbiting scroll can increases the lubrication area between the end plate (71) of the orbiting scroll (70) and the outer peripheral wall (63) of the fixed scroll (60). In addition, the oil groove (83) on orbiting scroll (70) moves with the orbiting scroll (70). Thus, the distance (the sealing length of the oil groove (83) on the orbiting scroll) from the oil groove (83) on the orbiting scroll to the end of the outer periphery of the end plate (71) of the orbiting scroll (70) remains invariant irrespective of the angle of orbital movement of the orbiting scroll (70). Therefore, in the present invention, the sealing length of the oil groove (83) on the orbiting scroll does not become short in eccentric orbital movement of the orbiting scroll (70). Consequently, the leakage of the high pressure lubricating oil is reduced, and the lubrication area on the thrust surface between the outer peripheral wall (63) of the fixed scroll (60) and the end plate (71) of the orbiting scroll (70) is sufficiently obtained.

A second aspect of the invention is directed to the scroll compressor in the first aspect of the invention wherein the oil groove (83) on the orbiting scroll extends from one end of the oil groove (80) on the fixed scroll along a periphery of the end plate (71).

In the second aspect of the invention, the oil groove (83) on the orbiting scroll is disposed on the surface, of the end plate (71), that is in sliding contact with the outer peripheral wall (63) of the fixed scroll (60). The oil groove (83) on the orbiting scroll also extends from the end of the oil groove (80) on the fixed scroll along the periphery of the end plate (71). This configuration increases the lubrication area on the thrust surface between the outer peripheral wall (63) of the fixed scroll (60) and the end plate (71) of the orbiting scroll (70) along the periphery of the end plate (71).

A third aspect of the invention is directed to the scroll compressor in the first or second aspect of the invention wherein in eccentric orbital movement of the orbiting scroll (70), the oil groove (83) on the orbiting scroll moves between a position where the oil groove (83) on the orbiting scroll communicates with the oil groove (80) on the fixed scroll and a position where the oil groove (83) on the orbiting scroll is disconnected from the oil groove (80) on the fixed scroll.

In the third aspect of the invention, the orbiting scroll (70) orbiting eccentrically enables the oil groove (83) on the orbiting scroll to communicate with the oil groove (80) on the fixed scroll. In this position, the high pressure lubricating oil in the oil groove (80) on the fixed scroll is charged into the oil groove (83) on the orbiting scroll. From this position, the orbiting scroll (70) orbiting eccentrically disconnects the oil groove (83) on the orbiting scroll from the oil groove (80) on the fixed scroll. In this position, the oil charged into the oil groove (83) on the orbiting scroll is supplied to the sliding surface around the oil groove (83) on the orbiting scroll. Thus, a fixed amount of the lubricating oil is supplied to the portion further extending from the one end of the oil groove (80) on the fixed scroll. In addition, when the lubricating oil in the oil groove (83) on the orbiting scroll disconnected from the oil groove (80) on the fixed scroll leaks to the outside of the orbiting scroll (70), the amount of the leakage is only the amount corresponding to the volume of the oil groove (83) on the orbiting scroll at most. Thus, the excessive leakage of the lubricating oil can be reduced.

A fourth aspect of the invention is directed to the scroll compressor in the third aspect of the invention wherein the oil groove (83), on the orbiting scroll, that is disconnected from the oil groove (80) on the fixed scroll communicates with the compression pockets (41) between the fixed scroll (60) and the orbiting scroll (70).

In the fourth aspect of the invention, the oil groove (83) on the orbiting scroll disconnected from the oil groove (80) on the fixed scroll in eccentric orbital movement of the orbiting scroll (70) communicates with the compression pockets (41). Thus, a part of the oil charged into the oil groove (83) on the orbiting scroll is also supplied to the compression pockets (41). During this time, the oil groove (83) on the orbiting scroll communicating with the compression pockets (41) is disconnected from the oil groove (80) on the fixed scroll. Consequently, the high pressure lubricating oil in the oil groove (80) on the fixed scroll is not directly and continuously supplied to the compression pockets (41) through the oil groove (83) on the orbiting scroll.

Advantages of the Invention

In the present invention, the oil groove (83) on the orbiting scroll that can communicate with the oil groove (80) on the fixed scroll is disposed on the end plate (71) of the orbiting scroll (70). This configuration reduces the leakage of the high pressure lubricating oil to the outside of the end plate (71), and also increases the lubrication area on the thrust surface corresponding to the outer peripheral wall (63). That is, this configuration can improve the lubrication characteristics between the fixed scroll (60) and the orbiting scroll (70), and the reliability of the scroll compressor (10).

In the second aspect of the invention, the oil groove (83) on the orbiting scroll extends from the end of the oil groove (80) on the fixed scroll along the periphery of the end plate (71). This configuration can further increase the lubrication area on the thrust surface.

In particular, in the third aspect of the invention, in eccentric orbital movement of the orbiting scroll (70), the lubricating oil in the oil groove (80) on the fixed scroll is intermittently supplied to the oil groove (83) on the orbiting scroll. Thus, a fixed amount of the lubricating oil is appropriately supplied to the thrust surface corresponding to the outer peripheral wall (63). Consequently, the lubricating oil can be quantitatively supplied to the sliding surface (63*a*) depending on the size of the oil groove (83) on the orbiting scroll, and the excessive supply of the lubricating oil can be reduced.

Moreover, in the fourth aspect of the invention, a part of the oil in the oil groove (83) on the orbiting scroll is also supplied to the compression pockets (41). Thus, the lubricating oil from the oil groove (83) on the orbiting scroll can also be used to lubricate the sliding areas on the wraps (62, 72) in the compression pockets (41). Furthermore, the oil is reliably appropriately discharged from the oil groove (83) on the orbiting scroll. Thus, this configuration reduces accumulation of the oil in the oil groove (83) on the orbiting scroll. This configuration also reduces rise in an oil temperature, thereby avoiding decrease in lubrication characteristics, e.g., viscosity, of the lubricating oil, which is caused by the rise in the oil temperature. In addition, the oil groove (83) on the orbiting scroll communicating with the compression pockets (41) is disconnected from the oil groove (80) on the fixed scroll. Thus, this configuration can reduces a direct flow of the oil in the oil groove (80) on the fixed scroll into the compression pockets (41). Consequently, this configuration can also avoid heating of a refrigerant supplied to the compression pockets (41) occurring due to excessive supply of the lubricating oil to the compression pockets (41).

BRIEF DESCRIPTION OF THE DRAWINGS

FIG. 3 illustrates a first state where an oil groove on the fixed scroll communicates with an oil groove on an orbiting scroll.

FIG. 4 illustrates a first state where the oil groove on the fixed scroll is disconnected from the oil groove on the orbiting scroll.

FIG. 5 illustrates a second state where the oil groove on the fixed scroll communicates with the oil groove on the orbiting scroll.

FIG. 6 illustrates a second state where the oil groove on the fixed scroll is disconnected from the oil groove on the orbiting scroll.

FIG. 7 illustrates a state where an oil groove on the fixed scroll communicates with an oil groove on an orbiting scroll.

FIG. 8 illustrates a state where the oil groove on the fixed scroll is disconnected from the oil groove on the orbiting scroll.

DESCRIPTION OF EMBODIMENTS

The embodiments of the present invention will be described in detail with reference to the drawings.

Figure 1:
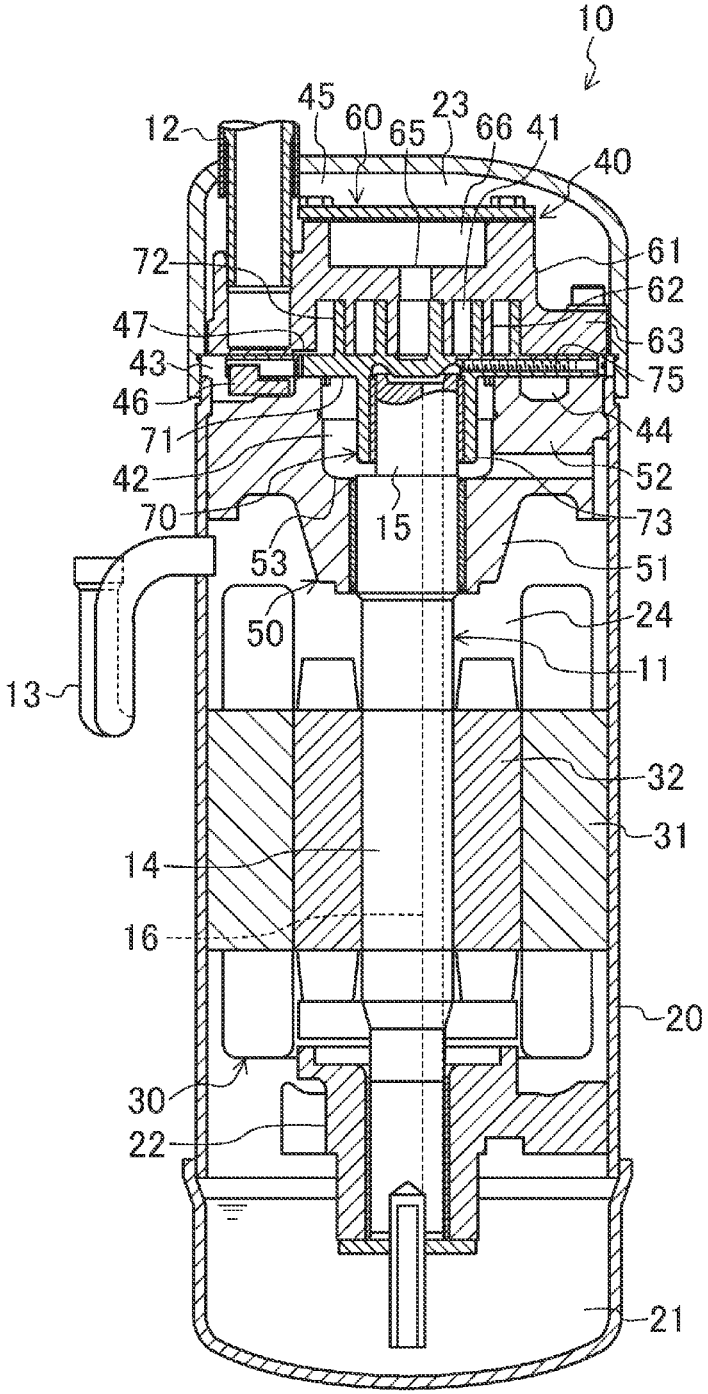
FIG. 1 is a longitudinal sectional view of a scroll compressor of an embodiment.
Figure 2:
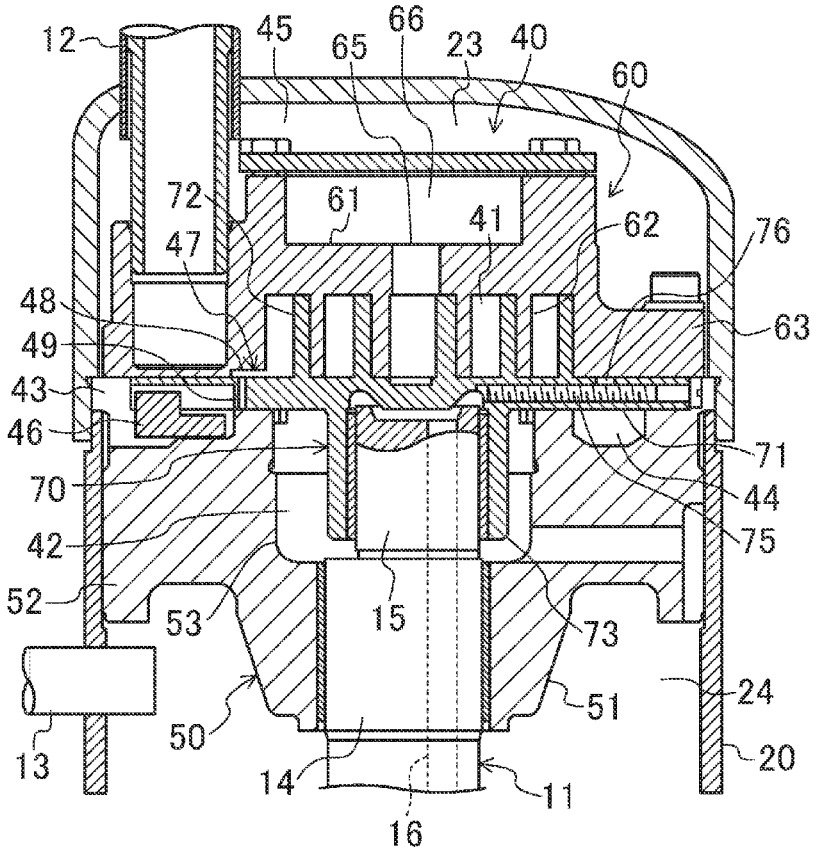
FIG. 2 is a longitudinal sectional view of a principal part of the scroll compressor of the embodiment.

As illustrated in FIGS. 1 and 2, a scroll compressor (10) of this embodiment provided in a refrigerant circuit of a vapor compression refrigerating cycle to compress a fluid refrigerant.

The scroll compressor (10) includes a casing (20), a motor (30), and a compression mechanism (40). The casing (20) accommodates the motor (30) and the compression mechanism (40). The casing (20) includes a long cylindrical portion and a hermetic dome.

The motor (30) includes a stator (31) fixed to the casing (20), and a rotor (32) disposed inside the stator (31). A driving shaft (11) is disposed through and fixed to the rotor (32).

The casing (20) has a bottom portion serving as an oil reservoir (21) storing lubricating oil. The casing (20) also has an upper portion through which a suction pipe (12) is disposed, and a middle portion coupled with a discharge pipe (13).

A housing (50) is fixed to the casing (20) and disposed above the motor (30). The compression mechanism (40) is disposed above the housing (50). The discharge pipe (13) includes a suction port disposed between the motor (30) and the housing (50).

The driving shaft (11) is longitudinally disposed along the casing (20). The driving shaft (11) includes a main shaft (14) and an eccentric portion (15) coupled with an upper end of the main shaft (14). The main shaft (14) has a lower portion fixed to the casing (20) through a lower bearing (22). The main shaft (14) has an upper portion disposed though the housing (50) and fixed to an upper bearing (51) of the housing (50).

The compression mechanism (40) includes a fixed scroll (60) fixed to an upper surface of the housing (50), and an orbiting scroll (70) meshing with the fixed scroll (60). The orbiting scroll (70) is disposed between the fixed scroll (60) and the housing (50), and provided on the housing (50).

The housing (50) has an outer periphery on which a ring-shaped portion (52) is disposed. The housing (50) also has an upper central portion that is a recessed portion (53). The housing (50) includes the upper bearing (51) below the recessed portion (53). The housing (50) is press-fitted to the casing (20). An inner peripheral surface of the casing (20) is in hermetic contact with an outer peripheral surface of the ring-shaped portion (52) of the housing (50) over the entire contact surface therebetween. The housing (50) separates an inside of the casing (20) into an upper space (23) accommodating the compression mechanism (40) and a lower space (24) accommodating the motor (30).

The fixed scroll (60) includes an end plate (61), an outer peripheral wall (63), and a wrap (62). The outer peripheral wall (63) is generally cylindrical and stands on an edge of an front surface (a lower surface in FIGS. 1 and 2) of the end plate (61). The wrap (62) is spiral (or involute) and stands inside the outer peripheral wall (63) on the end plate (61). The end plate (61) is disposed on the outer peripheral side, and continuous to the wrap (62). An edge surface of the wrap (62) is generally flush with an edge surface of the outer peripheral wall (63). The fixed scroll (60) is fixed to the housing (50).

The orbiting scroll (70) includes an end plate (71), a wrap (72), and a boss (73). The wrap (72) is spiral (or involute) and disposed on a front surface (an upper surface in FIGS. 1 and 2) of the end plate (71). The boss (73) is disposed on the center of a back surface of the end plate (71). The boss (73) is coupled with the driving shaft (11) of which the eccentric portion (15) is disposed inside the boss (73).

Figure 3:
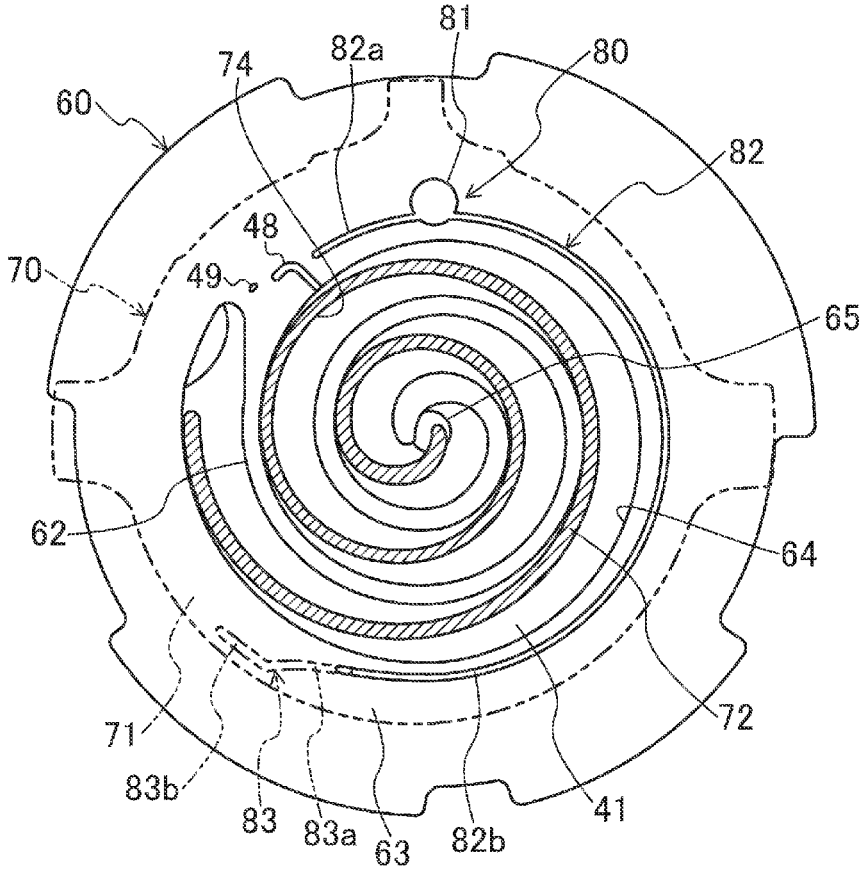
FIG. 3 is a bottom view of a fixed scroll of the scroll compressor of the embodiment.

The wrap (62) of the fixed scroll (60) meshes with the wrap (72) of the orbiting scroll (70). There are compression pockets (41) between the wrap (62) of the fixed scroll (60) and the wrap (72) of the orbiting scroll (70). That is, as illustrated in FIG. 3, the fixed scroll (60) includes a wrap groove (64) between the outer peripheral wall (63) and the wrap (62). The orbiting scroll (70) also includes a wrap groove (74) along the wrap (72). The wrap grooves (64, 74) serve as the compression pockets (41).

A suction port (not shown) is provided on the outer peripheral wall (63) of the fixed scroll (60). The suction port is connected with a downstream end of the suction pipe (12).

A discharge port (65) is provided on the center of the end plate (61) of the fixed scroll (60). A high pressure chamber (66) to which the discharge port (65) opens is provided on a back surface (an upper surface in FIGS. 1 and 2) of the end plate (61) of the fixed scroll (60). The high pressure chamber (66) communicates with a lower space (24) through a passage (not shown) in the end plate (61) of the fixed scroll (60) and a passage (not shown) in the housing (50). Thus, a high pressure refrigerant compressed by the compression mechanism (40) flows into the lower space (24) so that the lower space (24) is in a high pressure atmosphere.

The driving shaft (11) includes a lubrication passage (16) therein. The lubrication passage (16) extends from a lower end to an upper end of the driving shaft (11). The lower end of the driving shaft (11) is immersed in the oil reservoir (21). The lubrication passage (16) supplies lubricating oil in the oil reservoir (21) to the lower bearing (22) and the upper bearing (51). The lubrication passage (16) also supplies the lubricating oil to an sliding surface between the boss (73) and the driving shaft (11). Moreover, the lubrication passage (16), which opens to an upper end surface of the driving shaft (11), supplies the lubricating oil to a higher place than the driving shaft (11).

The ring-shaped portion (52) of the housing (50) has an upper inner periphery on which a sealing member (not shown) is disposed. A back pressure portion (42) that is a high pressure space is disposed closer to the center of the scroll compressor than the sealing member is. An intermediate pressure portion (43) that is an intermediate pressure space is disposed farther from the center of the scroll compressor than the sealing member is. In other words, the back pressure portion (42) is primarily in the recessed portion (53) of the housing (50). The recessed portion (53) communicates with the lubrication passage (16) in the driving shaft (11) through an inside of the boss (73) of the orbiting scroll (70). The back pressure portion (42) receives a high pressure corresponding to a discharge pressure of the compression mechanism (40), and this high pressure pushes the orbiting scroll (70) toward the fixed scroll (60).

The intermediate pressure portion (43) includes a pressure portion (44) closer to the orbiting scroll and a pressure portion (45) closer to the fixed scroll. The pressure portion (44) closer to the orbiting scroll covers a part of, or an outer periphery of the back surface of the end plate (71) of the orbiting scroll (70) and a lateral side of the end plate (71). That is, the pressure portion (44) closer to the orbiting scroll is disposed outside the back pressure portion (42), and the intermediate pressure in the pressure portion (44) pushes the orbiting scroll (70) toward the fixed scroll (60).

The pressure portion (45) closer to the fixed scroll is disposed outside the fixed scroll (60) in the upper space (23). The pressure portion (45) closer to the fixed scroll communicates with the pressure portion (44) closer to the orbiting scroll through a space between the outer peripheral wall (63) on the end plate (61) of the fixed scroll (60) and the casing (20).

The housing (50) includes a rotation stopper (46) for avoiding rotation of the orbiting scroll (70). The rotation stopper (46), which is, e.g., an Oldham coupling, is disposed on the upper surface of the ring-shaped portion (52) in the housing (50), and is in sliding contact with the end plate (71) of the orbiting scroll (70) and the housing (50).

The end plate (70 of orbiting scroll (70) includes an oil hole (75) therein. The oil hole (75) extends along the radius of the end plate (71), and includes an inner end, which is one end of the oil hole (75). The inner end communicates with a bottom portion (an upper portion in FIG. 2) of the boss (73). A screw is disposed inside the oil hole (75). A small hole (76) is disposed on the outer periphery of the end plate (71). The small hole (76) is disposed on an outer position than the wrap (72), and opens to a portion above the end plate (71). That is, the oil hole (75) supplies high pressure lubricating oil, supplied to an upper end of the lubrication passage (16) of the driving shaft (11), from the inside of the boss (73) to a sliding surface between the end plate (71) of the orbiting scroll (70) and the end plate (61) of the fixed scroll (60).

An adjustment groove (47) is disposed on the fixed scroll (60) and the orbiting scroll (70) to supply an intermediate pressure refrigerant to the intermediate pressure portion (43). The adjustment groove (47) includes a primary passage (48) disposed on the fixed scroll (60) and a secondary passage (49) disposed on the orbiting scroll (70). The primary passage (48) is disposed on a lower surface of the outer peripheral wall (63) of the fixed scroll (60). The primary passage (48) includes an inner end that opens to an inner end of the outer peripheral wall (63). The primary passage (48) communicates with the compression pockets (41) at an intermediate pressure where the wrap (72) of the orbiting scroll (70) is in contact with the outer peripheral wall (63).

On the other hand, the secondary passage (49) is a through hole disposed from a front surface to a back surface of the outer periphery of the end plate (71) of the orbiting scroll (70). The secondary passage (49) is a round hole of which a cross section (a cross section perpendicular to the axis of the round hole) is circle-shaped. Alternatively, the secondary passage (49) may have a cross section that is ellipse-shaped or arc-shaped. The secondary passage (49) includes an upper end intermittently communicating with an outer end of the primary passage (48). The secondary passage (49) includes a lower end communicating with the intermediate pressure portion (43) between the orbiting scroll (70) and the housing (50). That is, the compression pockets (41) at an intermediate pressure supply an intermediate pressure refrigerant to the intermediate pressure portion (43), which is in an atmosphere at a fixed intermediate pressure.

Configurations of Oil Grooves on Fixed Scroll and Orbiting Scroll

As illustrated in FIG. 3, the fixed scroll (60) includes an oil groove (80). The oil groove (80) on the fixed scroll is disposed on a front surface (a lower surface in FIG. 2) of the outer peripheral wall (63) disposed on the end plate (61) of the fixed scroll (60). The oil groove (80) on the fixed scroll includes a longitudinal hole (81) and a surrounding groove (82) passing across the longitudinal hole (81). The longitudinal hole (81) communicates with the small hole (76) on the oil hole (75) of the orbiting scroll (70) to supply high pressure lubricating oil to the surrounding groove (82). The surrounding groove (82) is disposed along an edge of an inner periphery of the outer peripheral wall (63). That is, the oil groove (80) on the fixed scroll is disposed along the edge of the inner periphery of the outer peripheral wall (63) on the fixed scroll (60). The oil groove (80) on the fixed scroll is also disposed on a surface, of the outer peripheral wall (63), that is in sliding contact with the end plate (71) of the orbiting scroll (70).

The surrounding groove (82) includes a first arc-shaped groove (82*a*) extending from the longitudinal hole (81) to one end (the counterclockwise direction in FIG. 3) of the surrounding groove (82). The surrounding groove (82) also includes a second arc-shaped groove (82*b*) extending from the longitudinal hole (81) to the other end (the clockwise direction in FIG. 3) of the surrounding groove (82). The distance between the second arc-shaped groove (82*b*) and the edge of the inner periphery of the outer peripheral wall (63) gradually decreases in the clockwise direction in FIG. 3.

As illustrated in FIG. 3, the orbiting scroll (70) includes an oil groove (83). The oil groove (83) on the orbiting scroll is disposed on the front surface (the upper surface in FIG. 2) of the outer periphery of the end plate (71) on the orbiting scroll (70). The oil groove (83) on the orbiting scroll is disposed along the edge of the outer periphery of the end plate (71) on the orbiting scroll (70). The oil groove (83) on the orbiting scroll includes a communication groove (83*a*) and an expansion groove (83*b*) continuously provided with communication groove (83*a*). The communication groove (83*a*) is a generally arc-shaped groove that is curved outwardly toward the compression pockets (41). The expansion groove (83*b*) is a straight groove that is disposed farther from the center of the end plate (71) than the communication groove (83*a*) is. That is, the oil groove (83) on the orbiting scroll includes the communication groove (83*a*) that is slightly bent in contrast to the expansion groove (83*b*) so that the communication groove (83*a*) is disposed closer to the center of the end plate (71) than the expansion groove (83*b*) is. The expansion groove (83*b*) and the communication groove (83*a*) may be generally straight.

Figure 4:
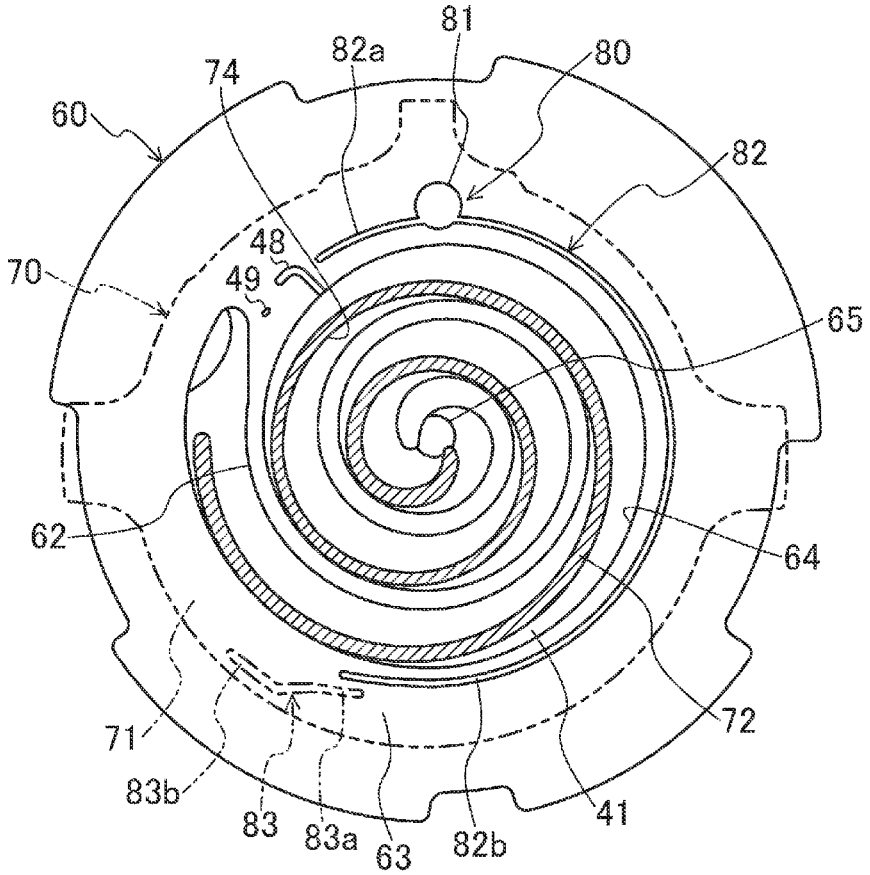
FIG. 4 is a bottom view of the fixed scroll of the scroll compressor of the embodiment.
Figure 5:
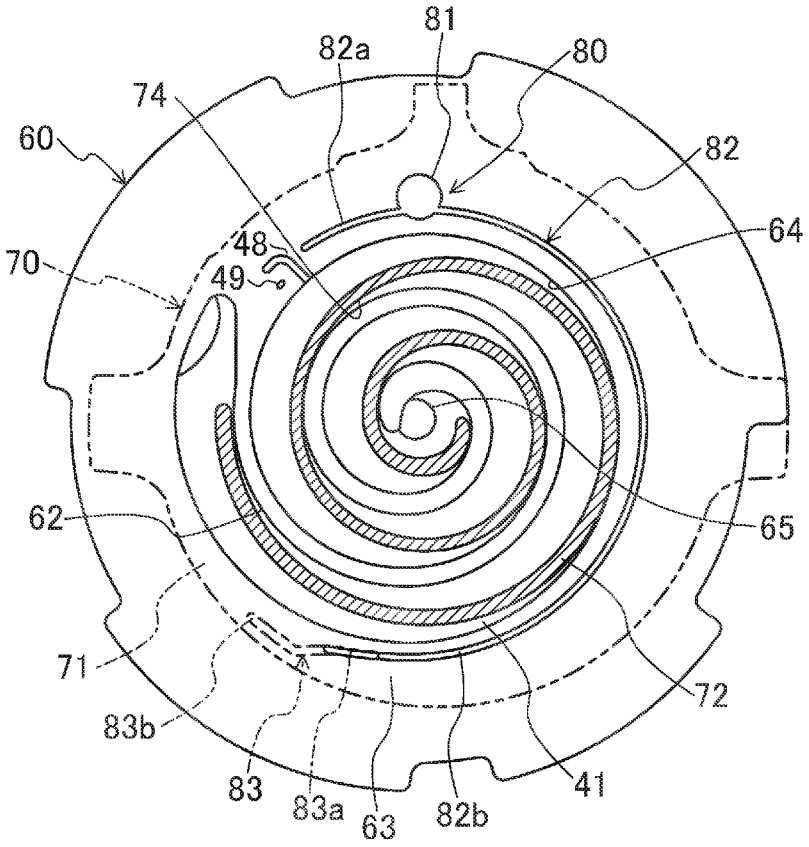
FIG. 5 is a bottom view of the fixed scroll of the scroll compressor of the embodiment.
Figure 6:
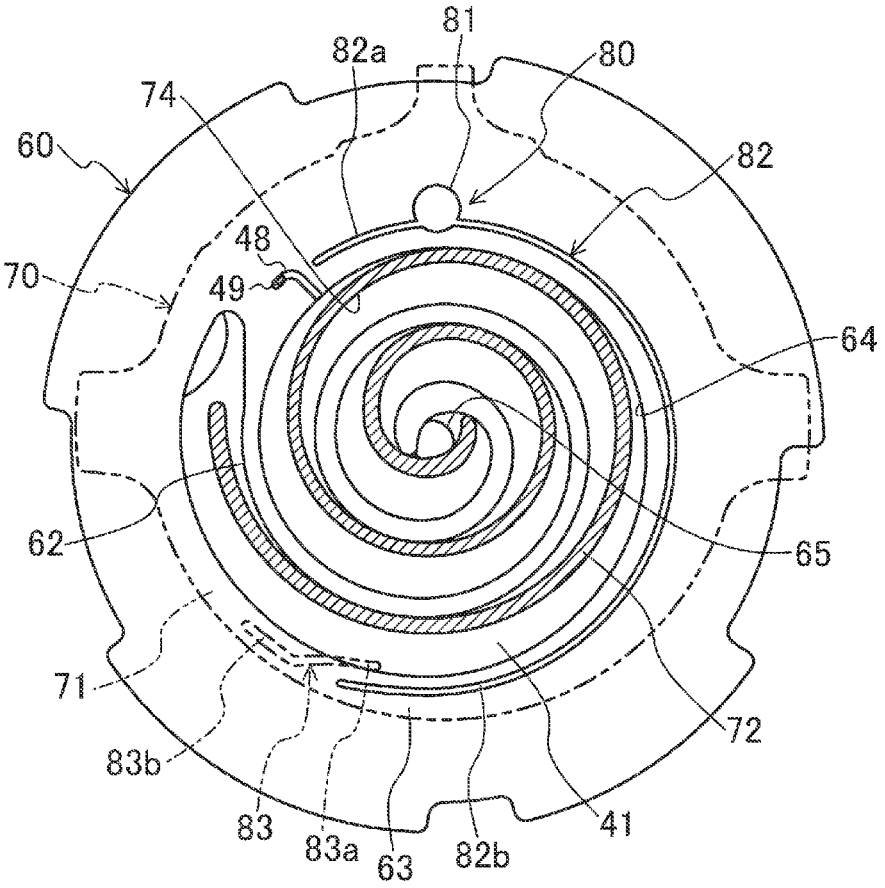
FIG. 6 is a bottom view of the fixed scroll of the scroll compressor of the embodiment.

In eccentric orbital movement of the orbiting scroll (70), the oil groove (83) on the orbiting scroll moves between a position where the oil groove (83) on the orbiting scroll communicates with the oil groove (80) on the fixed scroll (e.g., positions illustrated in FIGS. 3 and 5) and a position where the oil groove (83) on the orbiting scroll is disconnected from the oil groove (80) on the fixed scroll (e.g., positions illustrated in FIGS. 4 and 6). In addition, the oil groove (83) on the orbiting scroll of this embodiment communicates with the compression pocket (41) in the position where the oil groove (83) on the orbiting scroll is disconnected from the oil groove (80) on the fixed scroll (e.g., the position illustrated in FIG. 6). The oil groove (83), on the orbiting scroll, that communicates with the oil groove (80) on the fixed scroll extends from one end of the oil groove (80) on the fixed scroll along the periphery of the end plate (71).

Operation

Next, the operation of the scroll compressor (10) will be described.

The motor (30) allows the orbiting scroll (70) of the compression mechanism (40) to orbit. The orbiting scroll (70), which is prevented from rotating by the rotation stopper (46), only eccentrically orbits an axis of the driving shaft (11). In eccentric orbital movement of the orbiting scroll (70), the compression pockets (41), which decrease in volume toward the center, compress a refrigerant gas drawn from the suction pipe (12). The compressed refrigerant gas is discharged to the high pressure chamber (66) through the discharge port (65) of the fixed scroll (60). The high pressure refrigerant gas in the high pressure chamber (66) flows into the lower space (24) through the passages in the fixed scroll (60) and the housing (50). The refrigerant in the lower space (24) is discharged to the outside of the casing (20) through the discharge pipe (13).

The lower space (24) in the casing (20) keeps its pressure as high as a refrigerant to be discharged. The oil reservoir (21) also keeps the high pressure lubricating oil. The high pressure lubricating oil in the oil reservoir (21) flows from the lower end to the upper end of the lubrication passage (16) of the driving shaft (11). Then, the high pressure lubricating oil flows from an opening disposed on an upper end of the eccentric portion (15) of the driving shaft (11) to the inside of the boss (73) of the orbiting scroll (70). The oil supplied to the boss (73) lubricates the sliding surface between the boss (73) and the eccentric portion (15) of the driving shaft (11). Consequently, an atmosphere at a high pressure corresponding to the discharge pressure is provided from the inside of the boss (73) to the back pressure portion (42). This high pressure pushes the orbiting scroll (70) toward the fixed scroll (60).

There is the compression pocket (41) closest to the inner periphery of the outer peripheral wall (63) of the fixed scroll (60) in a state in which the wrap (72) of the orbiting scroll (70) is in contact with the outer peripheral wall (63) of the fixed scroll (60). This compression pocket (41) decreases in volume toward the center. This outermost compression pocket (41) communicates with the primary passage (48) of the adjustment groove (47). When the compression pocket (41) is at a predetermined intermediate pressure, the secondary passage (49) of the adjustment groove (47) communicates with the primary passage (48). Consequently, an intermediate pressure refrigerant is supplied to the pressure portion (44) closer to the orbiting scroll and the pressure portion (45) closer to the fixed scroll. Thus, an atmosphere at an intermediate pressure is provided on the back surface of the orbiting scroll (70) and around the fixed scroll (60). These intermediate pressure and high pressure pushes the orbiting scroll (70) toward the fixed scroll (60).

The oil supplied to the boss (73) flows into the oil groove (80) on the fixed scroll (60) through the oil hole (75) of the orbiting scroll (70). The high pressure lubricating oil in the oil groove (80) on the fixed scroll is supplied to a sliding-contact surface between the lower surface of the outer peripheral wall (63) of the fixed scroll (60) and the end plate (71) of the orbiting scroll (70) to lubricate the thrust surface.

Moreover, in eccentric orbital movement of the orbiting scroll (70), the high pressure lubricating oil on the oil groove (80) on the fixed scroll is supplied to the oil groove (83) on the orbiting scroll appropriately. This operation will be described in detail with reference to FIGS. 3-6.

The orbiting scroll (70) with the center displaced to a slightly left side in FIG. 3 allows an end of the communication groove (83*a*) of the oil groove (83) on the orbiting scroll to axially (the longitudinal direction in FIG. 3) overlap an end of the second arc-shaped groove (82*b*) of the oil groove (80) on the fixed scroll. Consequently, the high pressure lubricating oil in the oil groove (80) on the fixed scroll is supplied to and charged to the oil groove (83) on the orbiting scroll. The charged amount of the lubricating oil depends on the volume of the oil groove (83) on the orbiting scroll.

The orbiting scroll (70), eccentrically orbited counterclockwise from the position in FIG. 3, with the center displaced to a slightly lower side in FIG. 4 disconnects the oil groove (80) on the fixed scroll from the oil groove (83) on the orbiting scroll. The orbiting scroll (70) in this position allows the lubricating oil in the oil groove (83) on the orbiting scroll to lubricate the thrust surface around the oil groove (83) on the orbiting scroll. In this time, the lubricating oil in the oil groove (83) on the orbiting scroll might be leaked toward the outer periphery of the end plate (71) of the orbiting scroll (70). However, in this situation, the oil is not leaked so much from the oil groove (83) on the orbiting scroll to the outside because the oil groove (83) on the orbiting scroll is disconnected from the oil groove (80) on the fixed scroll.

The orbiting scroll (70), eccentrically orbited counterclockwise from the position in FIG. 4, with the center displaced to a slightly right side in FIG. 5 allows the end of the communication groove (83*a*) of the oil groove (83) on the orbiting scroll to axially (the longitudinal direction in FIG. 3) overlap the end of the second arc-shaped groove (82*b*) of the oil groove (80) on the fixed scroll again. Consequently, the high pressure lubricating oil in the oil groove (80) on the fixed scroll is supplied to and charged to the oil groove (83) on the orbiting scroll again. The charged amount of the lubricating oil depends on the volume of the oil groove (83) on the orbiting scroll.

The orbiting scroll (70), eccentrically orbited counterclockwise from the position in FIG. 5, with the center displaced to a slightly upper side in FIG. 6 disconnects the oil groove (80) on the fixed scroll from the oil groove (83) on the orbiting scroll. At the same time, the oil groove (83) on the orbiting scroll communicates with the compression pocket (41) that is pumping a refrigerant. Consequently, a differential pressure between the oil groove (83) on the orbiting scroll and the compression pockets (41) allows the lubricating oil in the oil groove (83) on the orbiting scroll to be supplied into the compression pockets (41). Accordingly, this lubricating oil can be used to lubricate the wraps (62, 72) in the compression pockets (41). As described above, the oil groove (83), on the orbiting scroll, communicating with the compression pockets (41) is disconnected from the oil groove (80) on the fixed scroll. Thus, the compression pockets (41) can pump the lubricating oil of which the amount corresponds to the volume of the oil groove (83) on the orbiting scroll at most. That is, in FIG. 6, the lubricating oil in the oil groove (80) on the fixed scroll is not directly supplied to the compression pockets (41) through the oil groove (83) on the orbiting scroll. Thus, this configuration can reduce heating of a pumped refrigerant due to excessive supply of the lubricating oil to the compression pockets (41). Note that, in FIG. 6, the primary passage (48) axially overlaps and communicates with the secondary passage (49). Thus, the intermediate pressure refrigerant in the compression pockets (41) is supplied to the intermediate pressure portion (43) through the primary passage (48) and the secondary passage (49), and the intermediate pressure portion (43) maintains its atmosphere at a fixed intermediate pressure.

The orbiting scroll (70) that has returned from the position in FIG. 6 to that in FIG. 3 allows the high pressure lubricating oil in the oil groove (80) on the fixed scroll to be supplied to the oil groove (83) on the orbiting scroll. The orbiting scroll (70) repeating the eccentric orbital movement in the order of FIGS. 3, 4, 5, and 6 allows the lubricating oil appropriately supplied to the oil groove (83) on the orbiting scroll to be appropriately used to lubricate the thrust surface and the sliding area on the compression pockets (41).

Advantages of Embodiment

In the above-described embodiment, the oil groove (83) on the orbiting scroll is disposed on the end plate (71) of the orbiting scroll (70). The oil groove (83) on the orbiting scroll also extends from the end of the oil groove (80) on the fixed scroll. This configuration reduces the leakage of the high pressure lubricating oil to the outside of the end plate (71), and also increases the lubrication area on the thrust surface corresponding to the outer peripheral wall (63). That is, this configuration can improve the lubrication characteristics between the fixed scroll (60) and the orbiting scroll (70), and the reliability of the scroll compressor (10).

In particular, in the above-described embodiment, as illustrated in FIGS. 3-6, in eccentric orbital movement of the orbiting scroll (70), the lubricating oil in the oil groove (80) on the fixed scroll is intermittently supplied to the oil groove (83) on the orbiting scroll. Thus, a fixed amount of the lubricating oil is appropriately supplied to the thrust surface corresponding to the outer peripheral wall (63) of the fixed scroll (60). Consequently, the lubricating oil can be quantitatively supplied to the sliding surface (63*a*) depending on the size of the oil groove (83) on the orbiting scroll, and the excessive supply of the lubricating oil can be reduced.

Moreover, in the above-described embodiment, a part of the oil in the oil groove (83) on the orbiting scroll is also supplied to the compression pockets (41). Thus, the lubricating oil from the oil groove (83) on the orbiting scroll can also be used to lubricate the sliding areas on the wraps (62, 72) in the compression pockets (41). Furthermore, the oil is reliably appropriately discharged from the oil groove (83) on the orbiting scroll. Thus, this configuration reduces accumulation of the oil in the oil groove (83) on the orbiting scroll. This configuration also reduces rise in an oil temperature, thereby avoiding decrease in lubrication characteristics, e.g., viscosity, of the lubricating oil, which is caused by the rise in the oil temperature. In addition, the oil groove (83) on the orbiting scroll communicating with the compression pockets (41) is disconnected from the oil groove (80) on the fixed scroll. Thus, this configuration can reduce a direct flow of the oil in the oil groove (80) on the fixed scroll into the compression pockets (41). Consequently, this configuration can also avoid heating of a refrigerant pumped to the compression pockets (41) occurring due to excessive supply of the lubricating oil to the compression pockets (41).

Alternative Example of Embodiment

Figure 7:
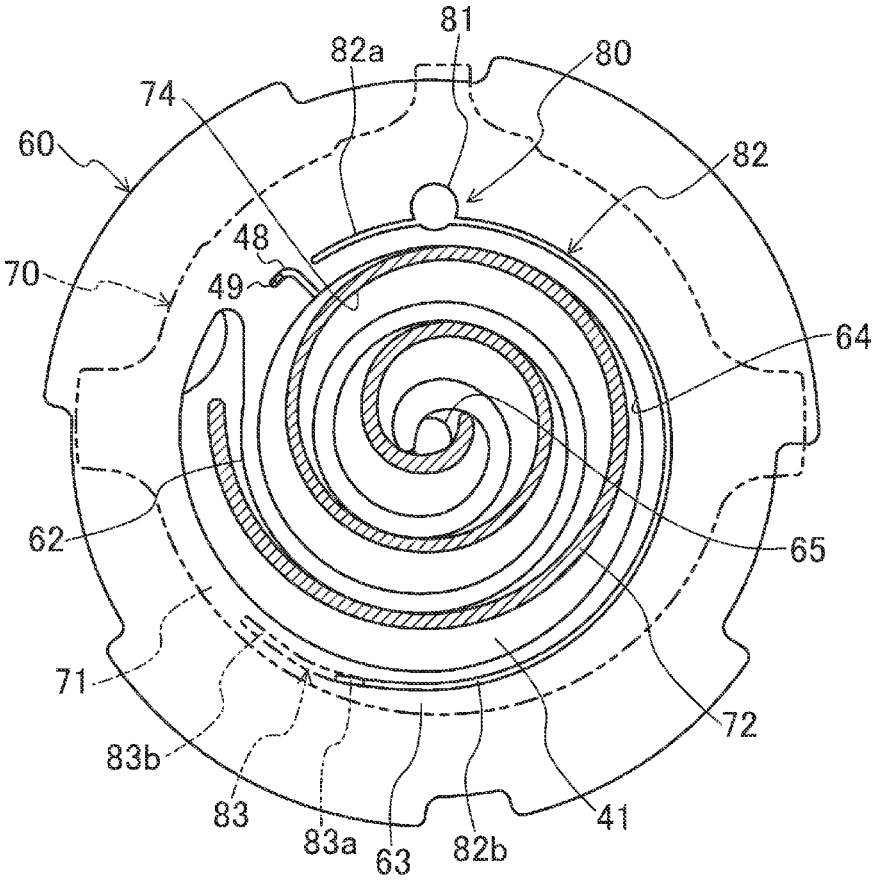
FIG. 7 is a bottom view of a fixed scroll of a scroll compressor of an alternative example.
Figure 8:
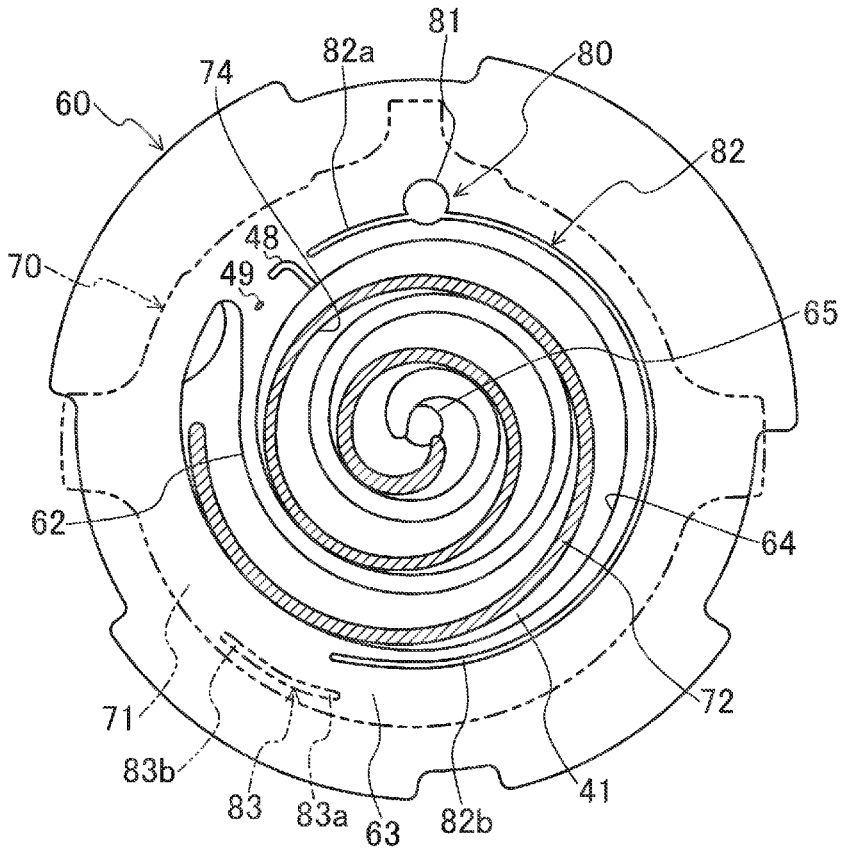
FIG. 8 is a bottom view of the fixed scroll of the scroll compressor of the alternative example.

FIGS. 7 and 8 illustrate an alternative example of an oil groove (83) on an orbiting scroll of a scroll compressor (10). In this alternative example, similarly to the above-described embodiment, the oil groove (83), on the orbiting scroll, that communicates with an oil groove (80) on a fixed scroll extends from one end of the oil groove (80) on the fixed scroll along a periphery of an end plate (71). In the alternative example, a communication groove (83*a*) of the oil groove (83) on the orbiting scroll is disposed farther from the center of the end plate (71) than the communication groove (83*a*) in the above-described embodiment is. That is, in the alternative example, the oil groove (83) on the orbiting scroll includes the communication groove (83*a*) and an expansion groove (83*b*) that extend in the generally same direction. In this alternative example, similarly to the above-described embodiment, in eccentric orbital movement of the orbiting scroll (70), the oil groove (83) on the orbiting scroll moves between a position where the oil groove (83) on the orbiting scroll communicates with the oil groove (80) on the fixed scroll (e.g., a position illustrated in FIG. 7) and a position where the oil groove (83) on the orbiting scroll is disconnected from the oil groove (80) on the fixed scroll (e.g., a position illustrated in FIG. 8). In addition, in the alternative example, when the oil groove (80) on the fixed scroll is in the closest position in relation to the compression pockets (41) (e.g., a position in FIG. 7), the oil groove (83) on the orbiting scroll does not directly communicates with the compression pockets (41).

In the above-described alternative example, the lubricating oil appropriately supplied from the oil groove (80) on the fixed scroll to the oil groove (83) on the orbiting scroll is actively used to lubricate the thrust surface on the outer peripheral wall (63). Thus, this configuration can increase the lubrication characteristics on this thrust surface, and improve the reliability of the scroll compressor (10). Note that the scroll compressor (10) in the alternative example preferably includes an oil supplier for individually supplying lubricating oil to the compression pockets (41).

Another Embodiment

Another embodiment may be as follows.

Unlike the scroll compressor (10), in the above-described embodiment, which compresses a refrigerant in a refrigerator including a refrigerant circuit, a scroll compressor (10) in this embodiment may compresses another fluid.

In addition, the shape of an oil groove (83) on an orbiting scroll in this embodiment may be different from that in the above-described embodiment. Specifically, in each of the above-described embodiment, the oil groove (83), on the orbiting scroll, that communicates with the oil groove (80) on the fixed scroll extends one end of the oil groove (80) on the fixed scroll along the periphery of the end plate (71). Alternatively, the oil groove (83) on the orbiting scroll may extend along the diameter of the end plate (71). The shape of the oil groove (83) on the orbiting scroll may be a perfect circle, or an ellipse.

INDUSTRIAL APPLICABILITY

As described above, the present invention relates to scroll compressors, more particularly to a lubrication structure.

What is claimed is:

1. A scroll compressor, comprising:

a compression mechanism including a fixed scroll including a first end plate, an outer peripheral wall extending from an edge of the first end plate, a first oil groove, and a first wrap extending from the first end plate inside of the outer peripheral wall; and an orbiting scroll including a second end plate in sliding contact with an end of the first wrap-and an end of the outer peripheral wall, a second oil groove, and a second wrap extending from the second end plate, the first oil groove of the fixed scroll disposed on a surface of the outer peripheral wall of the fixed scroll in sliding contact with the second end plate of the orbiting scroll, extending along an inner periphery of the outer peripheral wall, and configured to receive lubricating oil at a high pressure corresponding to a discharge pressure of the compression mechanism, the second oil groove of the orbiting scroll disposed on a surface of the second end plate of the orbiting scroll in sliding contact with the outer peripheral wall of the fixed scroll, and communicatable with the first oil groove of the fixed scroll, and the second oil groove of the orbiting scroll including a first portion disposed along an edge of an outer periphery of the second end plate of the orbiting scroll and a second portion bent toward a center of the orbiting scroll relative to the first portion and intermittently communicating with the first oil groove of the fixed scroll and a compression pocket.

* * * * *